United States Patent [19]

Jahns et al.

[11] 4,208,977

[45] Jun. 24, 1980

[54] ICEBREAKING APPARATUS

[75] Inventors: Hans O. Jahns, Houston; Joe D. Wheeler, Bellaire, both of Tex.

[73] Assignee: Exxon Production Research Company, Houston, Tex.

[21] Appl. No.: 861,737

[22] Filed: Dec. 19, 1977

Related U.S. Application Data

[63] Continuation-in-part of Ser. No. 816,573, Jul. 18, 1977, abandoned, which is a continuation-in-part of Ser. No. 684,324, May 7, 1976, abandoned.

[51] Int. Cl.[2] ..... B63B 35/08

[52] U.S. Cl. ..... 114/40

[58] Field of Search ..... 114/43, 40, 41, 42; 180/3 A, 186, 188, 7 A; 299/24, 25, 26, 27, 28; 175/18

[56] References Cited

U.S. PATENT DOCUMENTS

| | | | |
|---|---|---|---|
| 1,334,788 | 3/1920 | Pasko | 180/3 |
| 2,551,967 | 5/1951 | Pouliot | 114/42 |
| 3,667,416 | 6/1972 | Fioravanti | 114/42 |

*Primary Examiner*—Sherman D. Basinger

*Attorney, Agent, or Firm*—David A. Roth; Marc L. Delflache

[57] ABSTRACT

The invention relates to a water navigable vessel having an ice-breaking bow and a rotatable screw mounted on the front on the bow for the purpose of advancing the vessel up onto an ice layer and failing the ice layer in flexural bending. The rotatable screw includes ice-cutting blades which form grooves within the top of said ice layer thus translating the rotational energy of said screw into a generally horizontal, (longitudinal) tractional force which pulls or drags the bow of said vessel forward and over said ice layer and, thereby, utilizes the mass of said bow to impart a downward gravitational force upon said layer of ice to cause it to fail flexurally.

19 Claims, 10 Drawing Figures

ICEBREAKING APPARATUS

CROSS REFERENCE TO RELATED APPLICATIONS

This application is a continuation-in-part of U.S. patent application Ser. No. 816,573, filed July 18, 1977 and now abandoned, which in turn is a continuation-in-part of Ser. No. 684,324, filed May 7, 1976, and now abandoned.

BACKGROUND OF THE INVENTION

1. Field of the Invention

The present invention pertains to apparatus for enabling a floating vessel or a fixed platform located in an ice covered body of water to resist the lateral forces exerted on it by a layer of ice to either remain on station or to move through the ice water.

2. Description of the Prior Art

When drilling or producing oil offshore, it is essential that the structure from which such operations are conducted stays in position over the wellbore. In the more northern and southern climates of the world, winter brings on freezing weather causing large ice layers to form on the bodies of water. Due to winds, tides and currents, these ice layers tend to move. Sometimes the forces present in these moving ice layers are capable of overturning fixed structures and oftentimes are sufficient to force floating vessels off location. To avoid these accidents and interruptions, it is necessary somehow to decrease the magnitude of the lateral forces of the ice layer acting on the offshore structures. Other than designing a fixed structure to withstand the expected ice layer forces, the apparent solution is to break and clear the ice surrounding the structure.

For fixed structures, proposed methods of breaking and clearing the ice have included mounting cones on the structure's support members to force the ice sheet to bend and fail as it moves against the cone's inclined surface, melting the ice layer around the structure, and milling the ice layer with ice cutters into relatively small pieces. Many of these proposed methods could be adapted for use by a floating vessel, with the ice milling method being advanced as the most promising. Yet, energy requirements for ice milling are expected to be extremely high and the technical and economic feasibility of this approach is by no means certain. Therefore a need exists for a practical system that will economically allow offshore structures to resist the lateral forces of moving layers of ice.

Systems for chipping ice are described in U.S. Pat. No. 3,768,428, and U.S. Pat. No. 3,888,544. A system for actually cutting ice is described in U.S. Pat. No. 3,921,560.

The device of U.S. Pat. No. 3,921,560 for cutting ice is located on the bow of a ship whereby the cutting member is a rotary, horizontally-mounted, helicoidal member.

Furthermore, it is known that screw devices of certain design can be used for supplying the propulsion force for a vessel whereby the screw is located below the surface of the water. This is illustrated by Hoke U.S. Pat. No. 2,806,441.

In addition, Ellis U.S. Pat. No. 1,482,511 shows a plurality of endless chains with ice scraping and breaking teeth mounted on the bow of the boat.

It is mentioned in U.S. Pat. No. 3,667,416 that the art is familiar with "Ships having a stem with a slope from the front to the rear, which permits the bow of the ship, again by the action of the propulsive force, to mount on the ice which is broken by the effect of the weight of the ship." Nothing is said, however, with respect to assisting the ice breaking bow of the ship to rise up (ride) on the ice by using dragging or pulling means in order to utilize the weight of the ship more effectively in combination with the propulsive force of the ship. Nor is anything said with respect to utilizing dragging or pulling means, without other propulsive force, to urge the ice-breaking bow of a ship to mount upon the ice layer.

Canadian Pat. No. 1,011,605 published 6/7/77 (too late to be a reference as of its publication date) discloses an ice breaking hull with support means mounted on a pontoon-shaped forecastle which means bear on unbroken ice.

Also, no references are known which are relevant to the embodiment utilizing a vertically oriented screw means to protect a vertical member at an approximately 90° angle to an ice layer.

SUMMARY OF THE INVENTION

Figure 1:
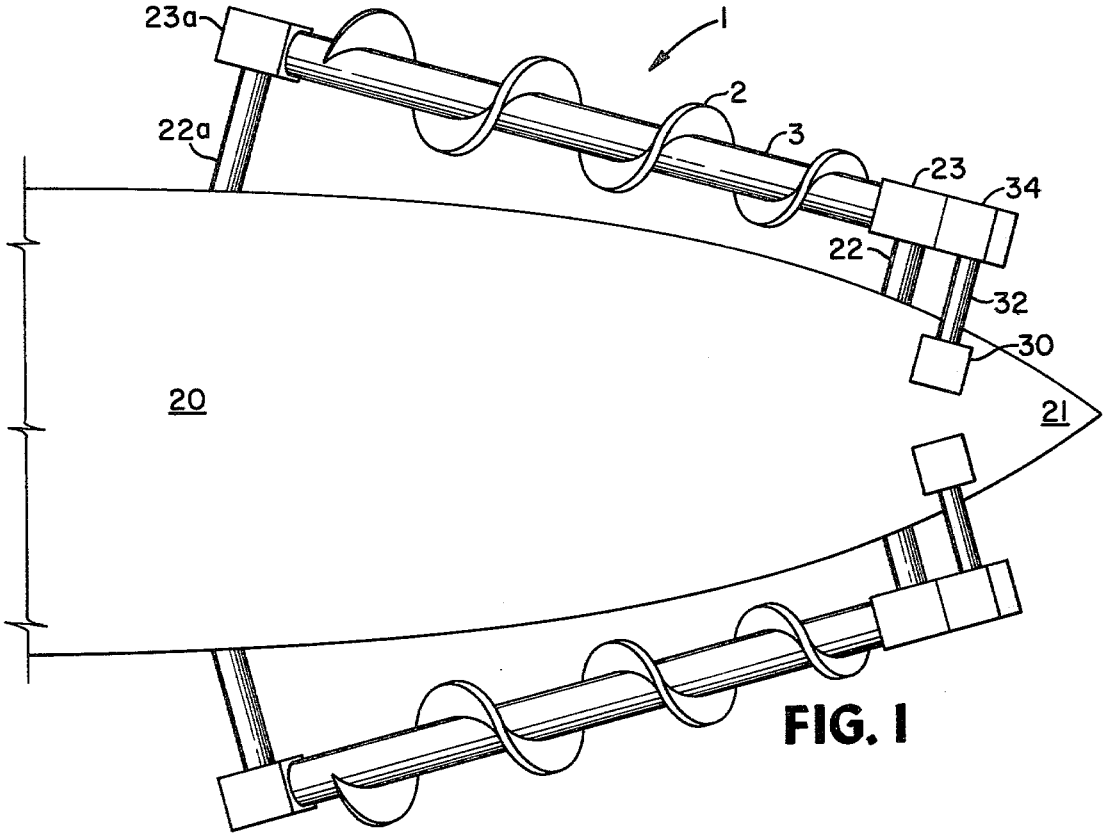
FIG. 1 is a schematic top view of the bow of an ice breaker-shaped vessel outfitted with apparatus of the present invention.

In its most generic aspect the invention herein can be viewed as comprising structures having improved ice-contacting means for heavy ice which is covering navigable water. These structures act upon the ice, causing the ice to fail in flexure. Processes based on such means are also within this generic concept.

The preferred ice-contacting means is a screw means having a relatively large length-to-diameter ratio. However, for some embodiments of the invention, other types of ice-contacting means are satisfactory.

SUMMARIZED ANALYSIS OF INVENTION

I. The Longitudinal Dimension Subgenus

The screw means acts upon the ice by contacting it in two basic modes. In one mode the screw means contacts and grips the upper portion of the ice along the longitudinal dimension of said screw means to impart a dragging or pulling motion to a structure associated with said screw means.

II. The Transverse Dimension Subgenus

In the second mode, the screw means contacts said ice in the transverse dimension of said screw means, essentially along the side of an ice mass to impart a lifting or depressing motion to said ice mass.

III. Analysis of Longitudinal Direction Embodiments and Species

A. In the longitudinal catagory, there is included:
  Vessels designed to remain on station.
  Floating vessels designed to move through ice floes.
  Floating vessels capable of both of said above characteristics.
B. The floating vessels above may be
  propelled by screw means alone,
  propelled by screw means in combination with auxiliary propulsion.
C. The auxiliary propulsion may be
  self-contained in the vessel,
  supplied by a source extrinsic to the vessel, (e.g. a pusher tug boat.)
D. The screw means will have a relatively high length-to-diameter ratio and will comprise:
  One or more independently mounted screws on said structure.
  preferably two screws; one mounted on each side of the front of said vessel.
E. The screw means will be mounted in a direction roughly parallel to the longitudinal axis of the vessel at a selected angle measured from the horizontal formed by the surface of the water on which the vessel floats.
F. The vessel will have a low constructed to facilitate mounting the top of an ice layer.
G. In addition to screw means, other dragging or pulling means such as chain means can be used to drag or pull the vessel with such bow upon the top surface of the ice to cause its failure in flexure.

IV. Analysis of Transverse Dimension Embodiment

A. Generally floating or stationary structures, e.g. platforms having support members, e.g. legs in a generally vertical direction with respect to the water surface.
B. Screw means journaled about such legs.
C. Ice masses contact the screw in its transverse dimension and thereby, depending on the direction of rotation, will be either lifted or depressed by the screws blades as a result of such rotation.

DETAILED DESCRIPTION OF THE INVENTION

The present invention in its preferred vessel embodiment alleviates the problems outlined above and provides means, preferably screw means, to enable a floating vessel to either remain on station resisting the lateral forces generated by moving ice layers or to move through the ice layer by operating in a unique ice-breaking mode.

As an alternate embodiment a fixed structure is provided with vertically oriented screw means to resist the substantially horizontally directed force of ice layers. Power means for rotating said screw means is also included.

The present invention in a generic sense comprises the use of suitable ice contacting means, especially screw means, suitably positioned on a floating or fixed structure at the water's surface to contact an adjacent ice layer at various preselected angles in order to move a structure, e.g. vessel, through an ice layer, or permit a structure, e.g. platform, to withstand the movement of large ice masses against said structure along the side of the screw means.

For the vessel embodiment, when rotated at suitable velocity, the screw means will interact with an adjacent ice layer and develop a tractional force tending to move the vessel upon the top of the ice layer and thereby permit the weight of the vessel to impose a bending moment on the ice layer until it fails in flexure. The ice breaking means of the present invention, in operation, breaks ice layers into much larger ice fragments than the milling processes of the art and therefore consumes much less energy than the art devices and achieves results not hitherto achievable.

For application of the present invention to ships or barges, in its preferred embodiment a pair of screws are mounted on the bow, one on either side. They are constructed and arranged to achieve an orientation so that when rotated, they pull the ship's bow up onto an adjacent ice layer. The bow is designed to be of the ice mounting type. This additional load from the bow causes the ice underneath to bend downward and fail.

Continued rotation of the screws will facilitate the clearing of the broken pieces of ice out of the path of the vessel and under or above the adjacent ice layer.

The present invention can be used not only to assist a vessel in moving through an ice covered body of water but also as to enable a vessel to remain on a preselected location or station without being displaced by moving ice masses or floes.

In a preferred fixed structure embodiment of the invention, the screws are located around and journaled to vertically located support members. For a semisubmerisible structure embodiment, the screws are located around and journaled to its legs. As the screws on these structures are rotated, the blades will either lift an adjacent ice layer or force it downward, depending on the direction of rotation of the screw. Bending of an ice layer will cause it to fail in flexure near the structure and thereby protect the structure from the force of the ice mass.

Embodiments of the present invention enabble an offshore structure or vessel to remain on station resisting the lateral forces of a moving ice layer or in the case of the vessel to move through the ice layer by breaking the ice layer into pieces.

In another embodiment of the invention ice breaking barges can be outfitted with a single or double screw in their bow. Propulsion can be supplied by exterior power sources (e.g. pusher tugs) or by power integrally located in the stern.

The apparatus of the present invention will therefore be seen to offer significant advantages over systems existing heretofore.

Briefly, the present invention comprises screw means rotatably mounted on a structure or vessel which is designed to be positioned within an ice covered body of water and a means for rotating the screws. As the screw means are rotated, they will interact with the ice layer causing it to bend and eventually fail in flexure.

Figure 2:
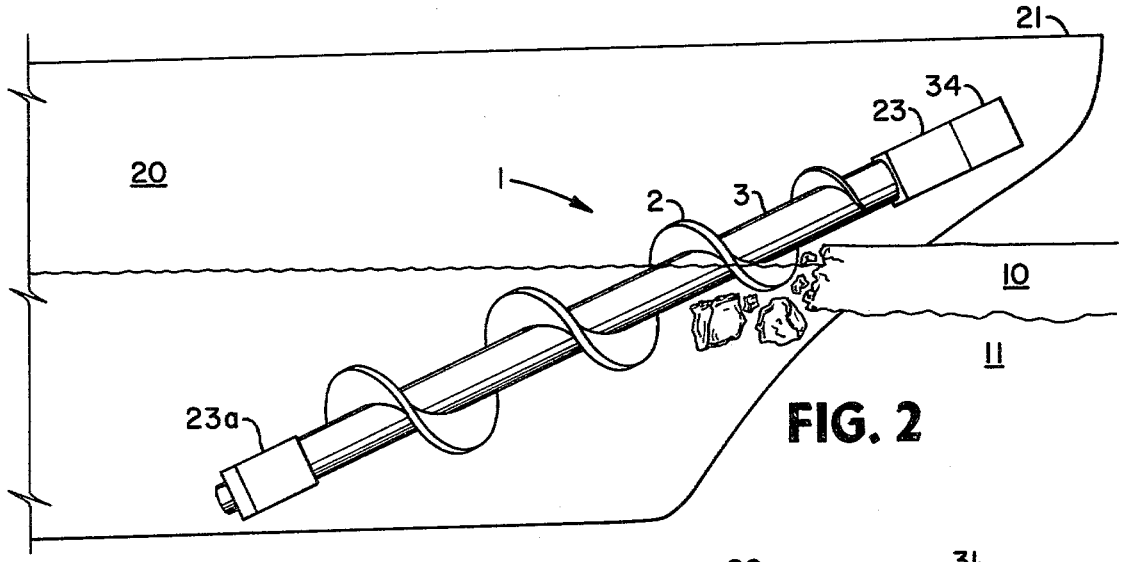
FIG. 2 is a schematic elevation view of the bow of the vessel depicted in FIG. 1.

The application of the present invention to an ice breaker-shaped vessel is depicted in FIG. 1 and 2. FIG.

1 is a top view and FIG. 2 an elevation view of the conventional bow 21 of a conventional icebreaking (by mounting the ice) vessel 20 equipped with the apparatus of the present invention.

As depicted in FIG. 1, a screw 1 is disposed on each side of the bow. Each screw 1 is comprised of a helical blade 2 affixed to a shaft 3. For use on an ice breaker vessel, it is anticipated that screws of the size needed could be either castor forged. The entire screw might be formed at once or sections of the screw, perhaps one pitch in length, could be formed and then welded together. The optimum combination of screw pitch, taper, length and blade depth for any specific application will depend on many factors including the size of the structure, the speed the screw is rotated, the thickness of the ice, the relative speed that the ice layer and structure are moving against each other and the strength of the ice.

In its simplest aspect the screw means employed in the present invention can be regarded as a simple machine analogous to a jack or a worm in a screw rack. In fact, a screw is really an inclined plane wrapped around a cylinder. The inclined plane assumes a generally helical configuration and sometimes is referred to as helicoidal.

A simple screw can be described as having a rotatable core provided with spaced-apart continuous helical flights mounted in a fixed position on said core. The flights form channels, sometimes called lands.

The total length of the flights or lands depends on the inclination or angle of the lands and on the diameter of the core. The angle of the lands is referred to as the pitch. Typically, the axial length of the flights may range from 1/10 to 5 diameters of core. The length to diameter (L/D) ratio of the screw will be from 2:1 to 25:1 preferably 2:1 to 15:1 and most preferably 2:1 to 10:1.

The pitch is defined as the length traversed along the longitudinal axis of the core for one complete turn of the flight or its projection along the helical axis. The pitch of the screw may increase from fore to aft.

The screw may be referred to as a right-handed screw or a left-handed screw depending on the direction of the helical flights when compared from their initial position.

The flights or lands can also be referred to as screw blades. For the purposes of this description the term blade is more appropriate.

Since the rotary movement of the screw causes the blades to gouge channels in the ice, which provides the grip and traction to permit the rotational movement of the screw to be translated into the horizontal pulling, dragging force for raising the bow of the vessel above the ice layer, it is important, if needed, to provide means at the blade edges to cut the ice e.g., ice cutting means. The grooves cut by the blade are referred to as traction grooves.

Drive units 30, mounted on board vessel 20, generate the power necessary to rotate the screws. The drive units can be powered by the vessel's main propulsion system or can be independent motors used only for rotating the screws. The drive units are shown schematically in FIG. 1 since they could be any type of engine or power source, including internal combustion, hydraulic, electric, or steam.

Figure 3:
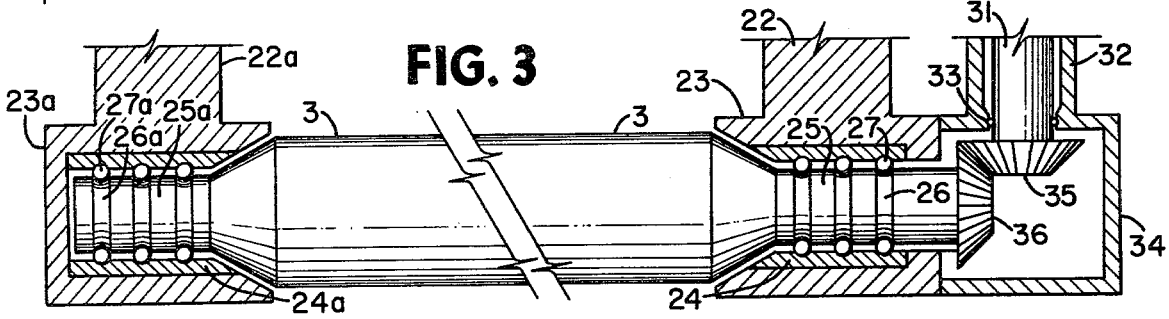
FIG. 3 is a cross-section of the journal boxes and gear box as used to support and drive the screws depicted in FIGS. 1 and 2.

In the illustrated especially preferred embodiment, the power to rotate the screw is transmitted from the drive unit 30 to the screw 1 through the drive linkage, which comprises drive shaft 31 and a set of bevel gears. The details of the drive linkage and journal boxes 23 and 23*a* are shown in FIG. 3. The drive shaft 31 extends from the drive unit 30, on board the vessel, through a protective casing tube 32 into gear box 34. The drive shaft 31 is rotatably supported by a bearing 33 in the gear box wall. Within the gear box 34, a bevel gear 35 is affixed to the drive shaft 31. Bevel gear 35 meshes with a second bevel gear 36, which is affixed to the end of the screw shaft 3.

The screw shaft 3 is rotatably supported within two journal boxes 23 and 23*a* which are rigidly affixed to the vessel 20 by support arms 22 and 22*a*. Within each journal box 23 and 23*a*, the screw shaft 3 tapers to smaller diameter journals 25 and 25*a*. Several bearing races 26 and 26*a* are formed in each journal 25 and 25*a*. The bearing races 26 and 26*a* are positioned and machined to match the bearing races 27 and 27*a* of the keys 24 and 24*a*. Bearings (not numbered) are, of course, disposed within said bearing races to permit screw shaft 3 to freely rotate.

While the drive units in this specific embodiment are located on the vessel, it may be more advantageous, in certain circumstances, to mount the drive unit directly on the screw shaft. For instance, if electrical power were available to drive the screws, a part of the shaft within a journal box could be engineered to be an electrical motor rotor and the journal box could be built to be the motor's stator.

Figure 4:
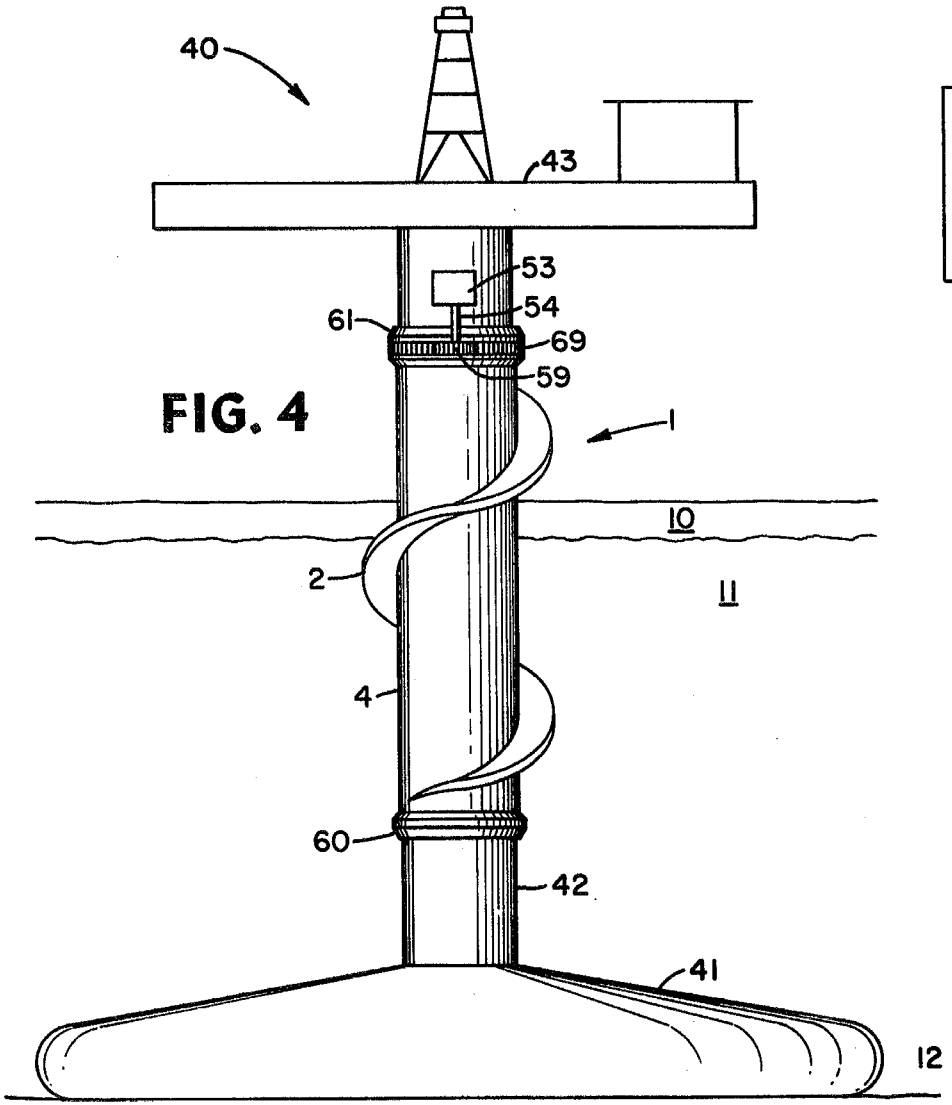
FIG. 4 is a schematic elevation view of a gravity founded drilling platform outfitted with apparatus of the present invention.

Another embodiment of the present invention is illustrated in FIG. 4. A gravity founded drilling platform 40 is shown with its base 41 resting on the bottom 12 of a body of water 11. A support column 42 rigidly attaches to the base 41 and extends vertically to support the deck 43 of the platform above the surface of the body of water. A large screw 1 is rotatably mounted about the support column 42 and is comprised of a sleeve 4, encasing the support column 42, and a helical blade 2 affixed to the sleeve 4.

The screw 1 is supported at its lower end by a support ring 60 which encircles the support column 42 and is rigidly attached thereto. The screw 1 is prevented from vertical movement up the support column 42 by an upper support ring 61 which also encircles the support column 42 to which it is rigidly affixed. About the top end of the sleeve 4, a ring gear 69 is attached. A spur gear 59, which is driven by a drive unit within the gravity structure 40, meshes with ring gear 69 to cause the screw 1 to rotate. The screw 1 should be vertically positioned on the support column 42 so that any ice layer, such as ice layer 10, moving against the platform 40 would contact the screw 1 along its side.

Figure 5:
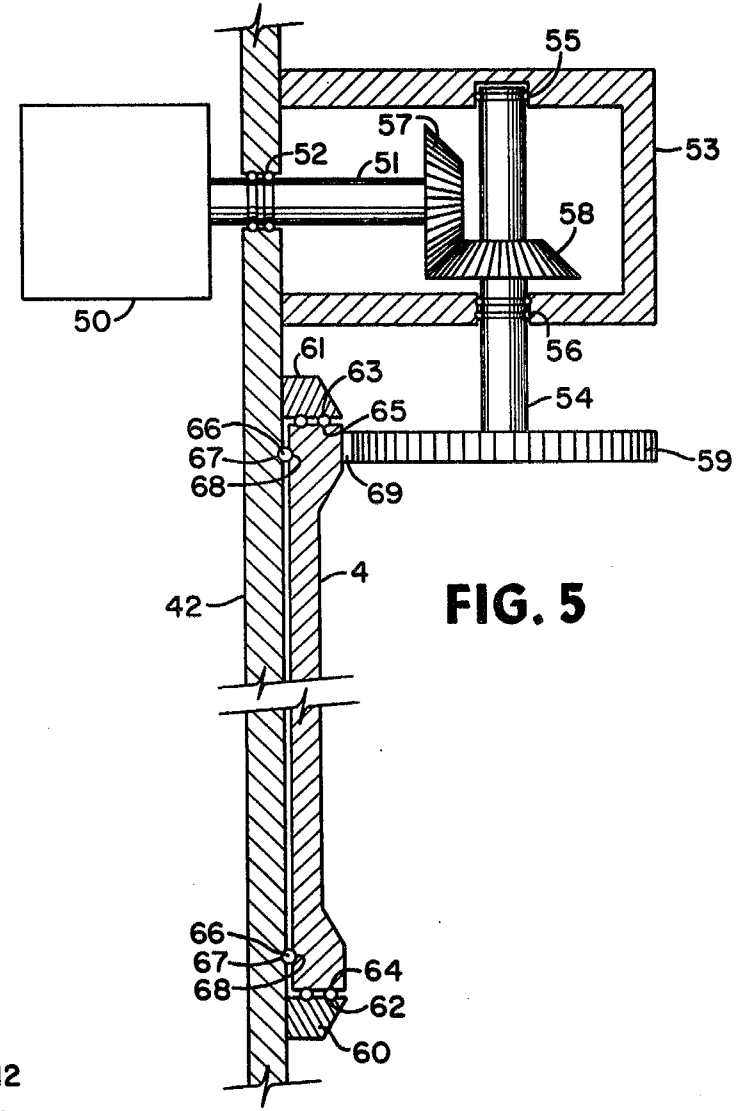
FIG. 5 is a partial cross-section of the screw sleeve and gear box of the gravity structure depicted in FIG. 4 and the floating or fixed platform depicted in FIG. 6.

The details of the means to rotate the screw 1 for the embodiment illustrated in FIG. 4 are shown in FIG. 5. The drive unit 50 is schematically depicted and, as in the previous embodiment, could be any of a number of possible types of engines. A drive shaft 51 connects with the drive unit 50 and extends through the wall of the support column 42 and terminates within gear bos 53 with a bevel gear 57 rigidly affixed to its end. Drive shaft 51 can be rotatably supported by bearings 52 in the wall of the support column 42. Bevel gear 57 meshes with a second bevel gear 68, which is rigidly affixed to the idler shaft 54. The idler shaft 54 is rotatably supported by two sets of bearings 55 and 56 in the top and bottom walls of the gear box 53. Attached to the lower end of the idler shaft 54 is a spur gear 59. The spur gear 59 meshes with the ring gear 69 on the screw sleeve 4.

The screw 1 is supported by the bottom support ring 60. Support ring 60 is rigidly attached to the wall of the support column 42. There are two bearing races 62 formed in the upper surface of support ring 60. Matching bearing races 64 are formed in the lower edge of the screw sleeve 4. As depicted, it may be desirable to increase the thickness of the sleeve 4 near its lower end so that the sleeve will be of sufficient thickness to house the bearing races. Ball bearings run in these bearing races 62 and 64 making it possible for the screw 1 to rotate.

When the screw 1 is rotated to interact with the ice layer, the forces may, depending on the direction of rotation, cause the screw 1 to move vertically up the support column 42. To prevent this vertical motion, a top support ring 61 is rigidly attached to the wall of the support column 42 just above the top of the screw sleeve 4. As with the upper surface of bottom support ring 60 and the lower edge of sleeve 4, bearing races 63 and 65 are formed, respectively, in the lower surface of the top support ring 61 and the upper surface of the top flared end of the top flared end of sleeve 4. Bearings ride in these races to facilitate rotation of the screw when the interaction of the ice and screw blade have forced the screw to move vertically up the support column 42 and bear against top support ring 61.

At intervals along the vertical length of the annulus between the inner surface of the screw sleeve 4 and the outer surface of the support column 42, mating bearing races 67 and 68 are formed, respectively, in the support column wall 42 and the sleeve 4. Each set of bearing races encircle the support column wall 42. Ball bearings 66 riding in these races maintain clearance between the sleeve 4 and the support column 42 along the entire vertical length of the screw 1. All of the various bearings shown in FIG. 5 should be sealed to prevent water intrusion. Alternatively, water might be expelled from the bearing races by periodically injecting into the bearing races, grease through grease runs that would be serviced from within the support column 42.

Figure 6:
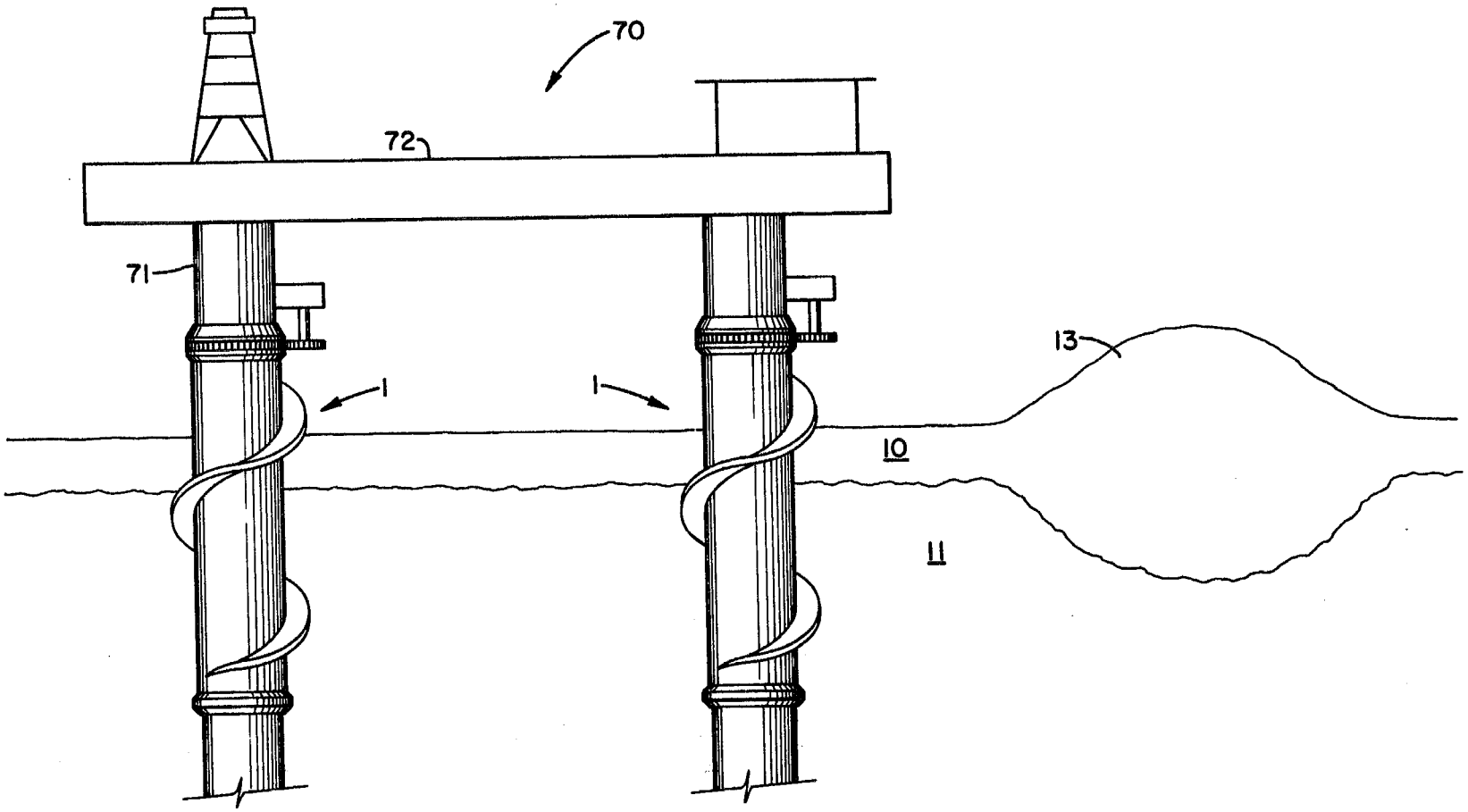
FIG. 6 is a schematic elevation of the deck and upper support columns of a floating or fixed platform outfitted with apparatus of the present invention.

FIG. 6 depicts still another embodiment of the present invention. Structure 70 is representative of either a semi-submersible drilling structure or a pile-founded fixed platform. The legs 71 support a working deck 72 above the body of water 11 and the layer of ice 10 floating thereon. Large screws 1 are rotatably mounted about each leg of the structure 70. They can be attached and rotated by the same means illustrated in FIG. 5.

Figure 7:
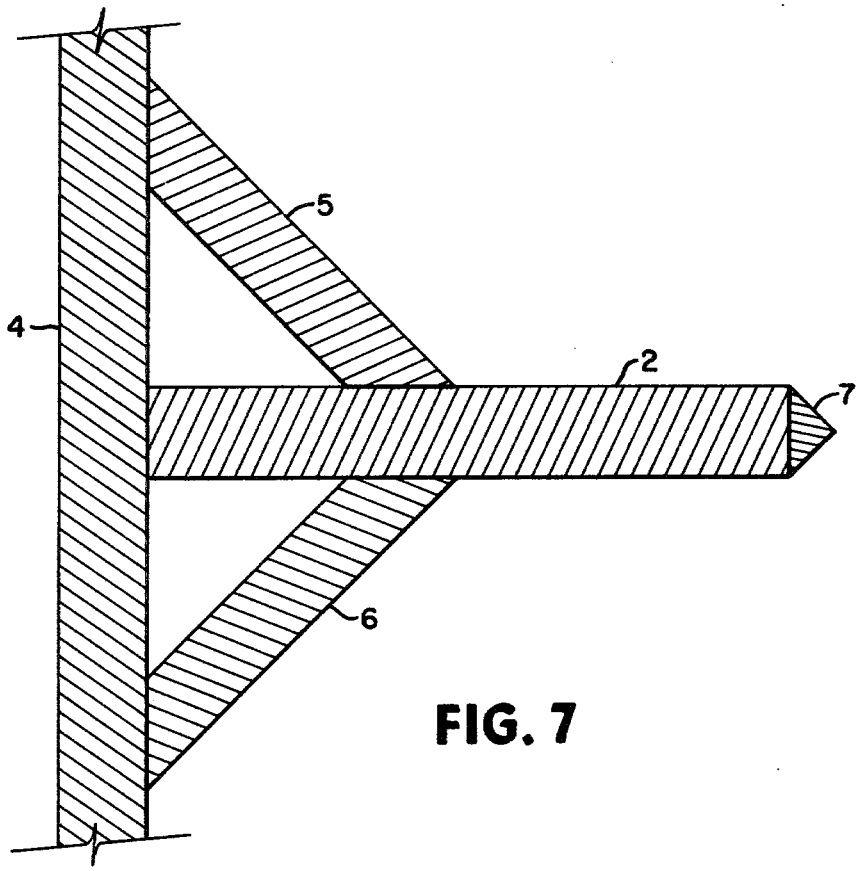
FIG. 7 is a cross-section of the screw sleeve and blade of a fabricated screw.

As previously noted, the screws for use on an ice breakingshaped vessel can be cast or forged. The larger screws for use on the legs of a platform or semi-submersible and on the support column of a gravity founded structure are anticipated to be too large for forging or casting and would have to be fabricated. FIG. 7 is a cross-sectional view of the helical blade 2 and screw sleeve 4 of a fabricated screw. The sleeve 4 is fabricated from pieces of steel plate. The blade 2 is formed by a plate welded at a right angle to the sleeve plate 4. The blade 2 would be inclined to the cylinder axis at the selected helix angle. Stiffener plates 5 and 6 are welded above and below the blade 2 to strengthen it. Cutting teeth 7, if desired, can be welded to the outer edge of the screw blade 2. The utility of cutting teeth will become evident.

To use the present invention for breaking a layer of ice on a body of water surrounding a structure or vessel positioned therein, it is necessary that a screw be adequately supported such as by journaling at a multiplicity of points along its length to the structure.

The screw should be aligned and positioned so that a layer of ice is contacted by the blades of the screw. For stationary structures the screw means is approximately with distances between blades (flights) essentially greater than the estimated thickness of the ice. As the screw is rotated, its blade will interact with the ice layer tending to lift or depress the ice layer depending on the direction of rotation and thereby impose a bending moment on the ice layer. A bending moment of sufficient magnitude will cause the layer of ice to fail in flexure.

With reference to the application of the present invention to a vessel with an ice breaker shaped bow, the line of contact with the upper ice surface (defined below) of the screw lies within the same vertical plane as the screw's axis of rotation but below the axis of rotation. The line of contact is that line within that vertical plane which connects the lowermost points on the crest or edge of the screw's blades. If the screw is not tapered, then the line of contact will be parallel to the screw's axis of rotation.

A single screw, usually centered longitudinally with the longitudinal axis of the vessel can be used. It is preferred to use two screws mounted on the vessel's bow, as illustrated in FIG. 1, one on each side of the longitudinal axis of the vessel. It is preferred that the screws 1 be aligned so that their respective lines of contact are upwardly inclined toward the leading ends of the screws at an angle greater than 0° but less than or equal to 45° from the horizontal when the vessel is at rest in the body of water. The screws 1 should be positioned on the bow 21 so that as the vessel 20 and ice layer 10 move against each other, the ice layer contacts the undersides of the screws. More precisely, the ice layer will at least be contacted by one or more points along the crest or edge of the screw's blade which are on the line of contact.

The screws 1 should preferably be located far enough away from the vessel 20 so that pieces of ice do not tend to wedge between the screws and the vessel to stop or impede the rotation of the screws. Depending on the shape of the bow of the vessel, it is possible that the longitudinal axes of the screws will be angled toward the bow of the vessel. (See FIG. 1.) If they are so angled, the vertical planes in which the axes of the screws lie should intersect the vertical plane containing the longitudinal axis of the vessel at angles equal to or less than 45°. Naturally, it is quite acceptable for these planes to be substantially parallel in a substantially vertical position. The vertical plane the screw lies in can be substantially parallel to the portion of the vessel opposite the screw.

When the vessel and the layer of ice are moving against each other, the screws will be rotated to interact with the ice layer to develop a tractional force tending to pull the icebreaking bow of the vessel 1 forward and upward onto the layer of ice 10. This will, of course, subject the screws to large forces having both vertical and horizontal components. The screws' support arms 22 and 22*a* must be sturdy enough to withstand these forces and transmit them to the vessel 20. Also, the bearings in the journal boxes must be designed to operate within the range of expected radial and axial forces.

Figure 10:
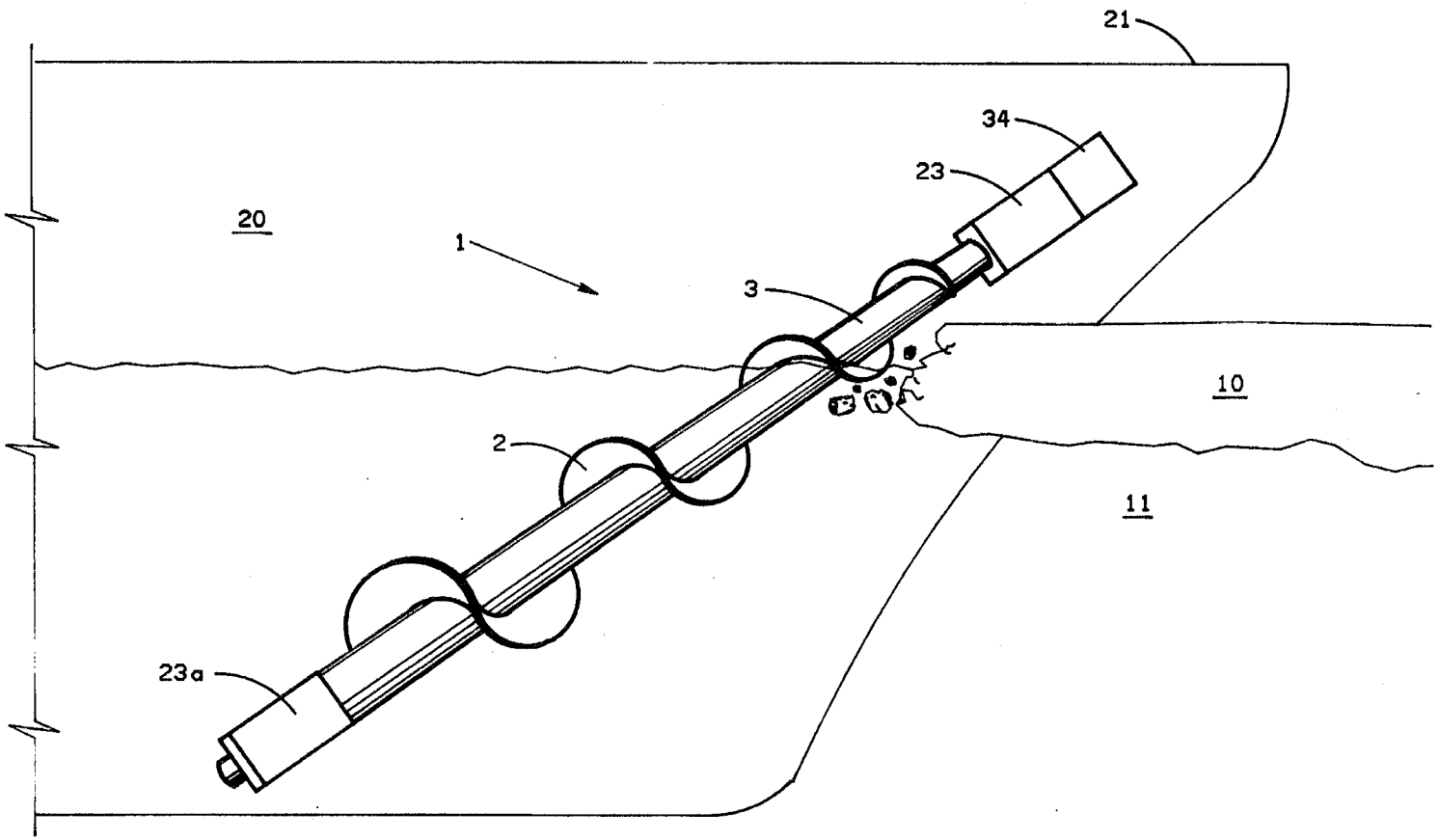
FIG. 10 is a detail of the bow of an ice breaker-shaped vessel outfitted with the apparatus of the present invention.

As the bow of the vessel is lifted, at least a part of the weight of the vessel will bend the ice layer downward to fail it in flexure. The rotating screws will tend to clear the broken ice out of the path of the vessel. If the vessel's width increases aft of the bow, the amount of broken ice will also increase aft of the bow since a continuously wider path aft of the bow is being broken through the layer of ice. To clear the broken ice more effectively from the vessel's path, the screws can be tapered by increasing the blade depth from fore to aft, as shown in FIGS. 1 and 2. The screws may also be tapered by increasing the diameters of the screw shafts or cores from fore to aft, as shown in FIG. 10.

As a vessel advances through a layer of ice, the ice layer will at least be contacted by points along the exterior of each screw blade which lie along the line of contact. Naturally, as a screw rotates, different points along the edge of the blade will lie along the line of contact and be making gripping contact with the ice layer at different moments in time. Although different points along the edge of the blade are actually making gripping contact with the ice layer at different times, points of contact are maintained continually between the edge of the screw blade and the ice layer. When the screws are rotated to pull the vessel forward above and through the ice layer, the points of contact indicated by gouges on the ice layer will be moving along the line of contact backward, i.e., fore to aft, with respect to the vessel.

With respect to the ice layer, the movement of the points of contact in a direction parallel to the vessel's direction of movement may be backward, i.e., toward the rear of the vessel, or may be forward or they may not be moving at all in a direction parallel to the vessel's direction of movement. It should be noted that the points of contact may move in a direction that is not exactly parallel to the direction of vessel movement due to the orientation of the screws on the vessel, but nevertheless will have a velocity component that is parallel to the vessel's direction. Assuming that the screws are being rotated to move the vessel forward through the ice layer, the movement of the points of contact relative to the ice layer in a direction parallel to the vessel's direction of movement has certain significance.

If the points of contact are moving forward, i.e., the same direction as the vessel is moving through the layer of ice, the screws are actually presenting resistance to the vessel's movement. The other propulsion systems of the vessel are forcing the vessel to move so fast through the ice that the screws are scraping the ice in opposition to the vessel's motion. This is known as negative slip and should be avoided since the screws are actually a hindrance to the vessel's movement through the ice layer.

If the points of contact are not moving in a direction parallel to the vessel's direction of movement, known as zero slip, the screws may or may not be making a contribution to the forward movement of the vessel. It is conceivable that the screws can be rotated at the zero slip condition with just enough torque to keep up with the vessel's movement but make no contribution to that movement. But if torque in excess of that amount is applied to the screws, the screws will then be contributing to the forward movement of the vessel.

It is preferred that the screw means and the means for rotating the screws on a specific vessel be adapted in a manner such that the screws can be rotated to move the points of contact with said ice relative to the ice layer in a direction parallel to the vessel's intended direction of travel, but in the opposite direction of such travel (i.e. with positive slip), at a velocity of up to twice that of the vessel's designed maximum velocity. Designed maximum velocity is defined as the maximum velocity relative to the ice layer, of the vessel in an ice covered body of water when it is intended that the screws are to assist the vessel's movement. Desirably, the slip velocity should be less than or equal (but opposite) to the vessel's velocity relative to the ice.

A greater amount of slip is acceptable for limited periods of time under certain circumstances such as starting from an essentially stationary condition in thick ice.

The present invention can be used to assist an ice breaker-shaped vessel either to move through an ice covered body of water or to maintain a fixed position in the body of water. Further, the present invention can be used both on self-propelled vessels and on non-self-propelled vessels, such as barges. Under certain circumstances, some means for pushing the vessel against the layer of ice may be required to prevent it from sliding backward. This force could be provided by a number of means including the screws themselves, a conventional mooring system, the vessel's main propulsion system or one or more pusher means such as tugs.

It should be noted that in the preferred embodiment of this invention for use with an ice breaker-shaped vessel, it is preferred that two screws be utilized. It is especially preferred that they be opposite handed, i.e., one right handed and the other left handed. (See FIG. 1.) This would necessitate rotating the screws in opposite directions for both screws to interact simultaneously with the ice layer to pull the bow of the vessel up onto the ice layer. Should the opposite handed screws be rotated in the same direction, the vessel might tend to pivot and assume a new heading.

It may also be desirable in some instances to design the screw means and their support means, e.g. arms in a manner such that the screws can be tilted out of the water or even detached from the vessel when the vessel is moving through an ice-free body of water. Otherwise, the screws may obstruct the flow of water by the vessel and thereby impose an added drag force on the vessel. The same may be true when there is only a thin or broken ice cover on the body of water. Alternatively, the screw means can be designed to assist in propelling a vessel.

At times, it may be desirable to enhance the bite e.g. grip and therefore the traction of the screw blades in the ice. Screw traction can be especially important when the vessel must cope with thick ice features, such as ridges. Screw traction can be increased by outfitting the crest of the blade with supplemental means for cutting grooves into the ice. The cutting means, such as cutting teeth (as shown in FIG. 7), would cut into the ice with greater facility than an ordinary blade edge to create a traction groove in which the screw blade can ride thereby increasing the pulling force of said screw means.

A feature of the screw concept of the present invention is an adaptation to permit use in conjunction with sea structures having one or more vertical support members or legs such as semi-submersible vessels, floating caissons, gravity-founded structures or pile-founded structures. In such a configuration the axis of rotation of the screw means which are journaled about the legs of a suitable structure will be essentially vertical. (See FIGS. 4 and 6.)

The screws must be located along the legs of the structures so that the side of each screw contacts the layer of ice as it moves against the structure approximately perpendicular to the longitudinal axis of said leg or support member. As a screw is rotated, its blades will interact with the ice layer to develop an upwardly directed or downwardly directed force tending to impose an upward or downward bending movement on the ice layer depending on the particular direction of said rotation. Thus, when rotated the screw will bend the ice layer either upward or downward depending on the direction of their rotation. Depending on the type of structure and the direction the screws are rotated, the forces necessary to bend the layer of ice until it fails must be borne by either the structure's mass, buoyancy, or attachment to the bottom of the body of water. The continuous bending and failing of the ice layer as it moves against the structure's moving screws renders the broken ice layer surrounding the structure incapable of transmitting significant lateral forces against it.

As was described with respect to the screws preferred for use on a vessel, the optimum combination of screw pitch, taper, length and blade depth for any specific application will depend on many factors including the size of the structure, the speed the screw is rotated, the thickness of the ice, the speed the ice layer is moving against the structure, the strength of the ice and the thickness of the ice layer. Detailed engineering design within the skill of the art can determine the proper values for these parameters.

As depicted in FIGS. 4 and 6, each screw should have a pitch greater than the anticipated ice layer thickness, regardless of the other screw characteristics. Should the layer of ice or features therein, such as pressure ridges (see ridge 13 in FIG. 6), be thicker than the pitch of the screw, it may be necessary to enhance the screw's traction by outfitting the screw with a means for cutting a traction groove into the ice. The cutting means would cut a groove in the side of the ice layer in which the screw blade could ride to thereby transmit forces from the structure to bend and fail the ice layer. One would also receive some grinding action which would contribute toward the overall relief from ice pressures. As previously mentioned, one means for cutting a groove in an ice layer would be to outfit the crest of the screw blade with cutting teeth.

EXAMPLE

A model test program was conducted to assess the feasibility of using a pair of screws mounted on the bow of an ice breaker-shaped vessel. A 1/36 scale model Wind Class ice breaker was used for these tests. The surface of the model was specially prepared in order to have the same friction factor as the full scale ship's hull would have with ice. The surface was sanded to produce a friction coefficient between the model and the ice of 0.25. The model was ballasted with weights distributed over its length to obtain a radius of gyration typical for an ice breaker. Two tapered screws having helix angles of 30° were mounted one on either side of the bow substantially as pictured in FIGS. 1 and 2.

A ¾ hp. D.C. motor was chosen to drive the screws. The motor RPM was varied by a D.C. motor speed controller. A gear box was installed which provided two output shafts each connected to one of the screws by a flexible shaft. The RPM of the screws was measured by counting pulses generated by a magnetic probe attached to a disk driven by a V-belt from the motor shaft. A torque meter was used during some of the tests to measure the torque of one screw. A force block, installed in the model, measured the model's resistance to the ice layer as the model was towed against it. During each test, the model was towed in the ice sheet and its velocity relative thereto was measured.

Figure 8:
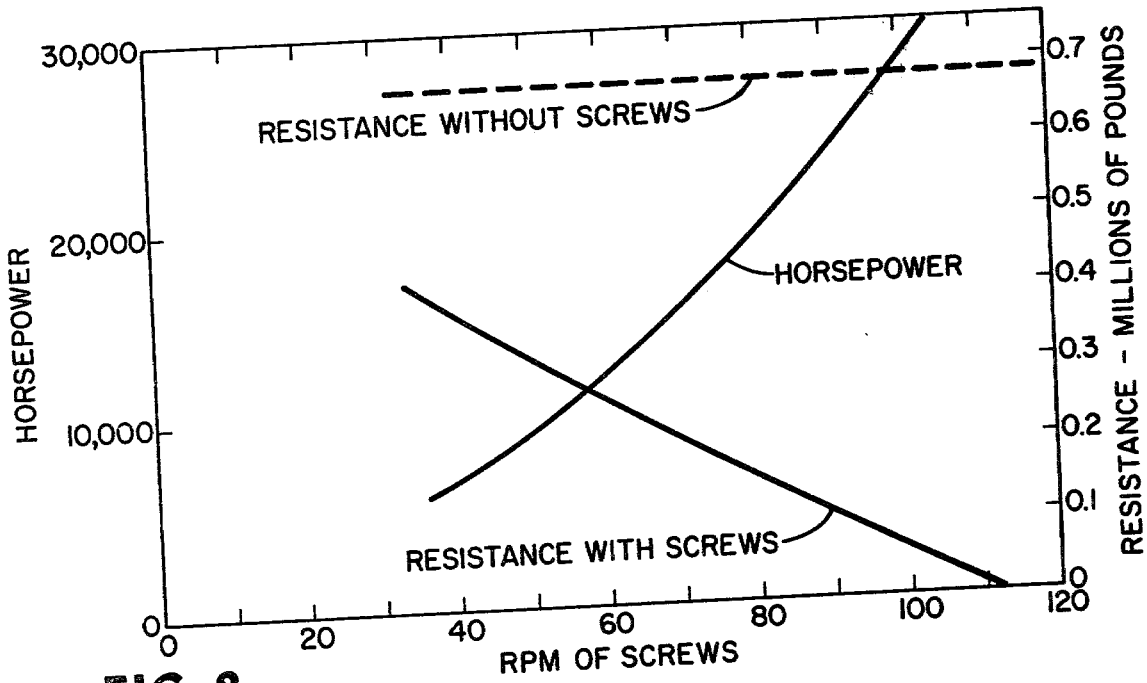
FIG. 8 is a plot of vessel resistance and horsepower versus the rotational speed of the screws.
Figure 9:
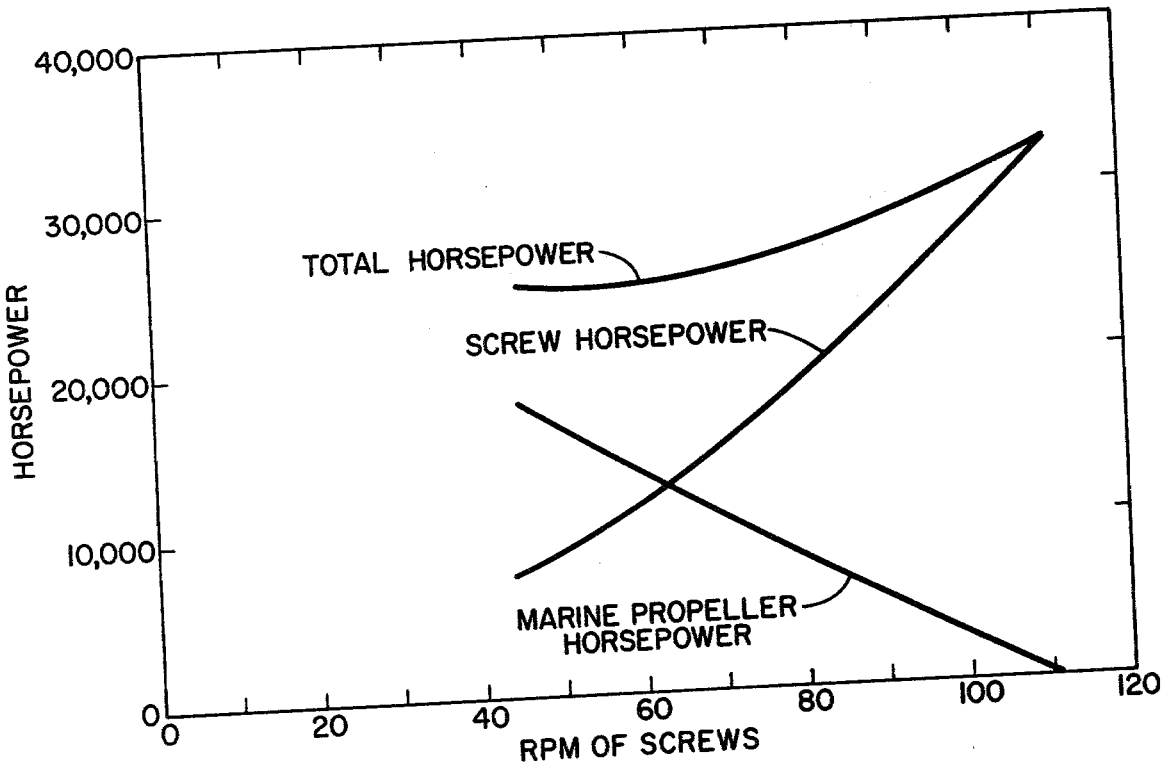
FIG. 9 is a plot of screw and propeller horsepower versus the rotational speed of the screws.

The model test data obtained was scaled up to predict the ice-breaking capability of a full-size Wind Class ice breaker equipped with a pair of screws mounted on its bow. FIGS. 8 and 9 illustrate some of the predicted capabilities of the full-scale ice breaker.

FIG. 8 plots the resistance to the movement through the ice of the ice breaker vessel equipped with a pair of screws and the horsepower required to rotate the screws versus the rotational speed of the screws. For this plot, the scale model was pulled through an ice layer having a full-scale equivalent thickness of 5.5 feet at a full-scale equivalent speed of 2.3 knots. The resistance to the vessel's motion through the ice decreased with increasing screw speed as shown by the plot labeled "Resistance with Screws." The horsepower required to rotate the screws increased with increasing screw speed. This relationship is shown by the plot labeled "Horsepower". For the purposes of comparison, the resistance to the movement of a full scale Wind Class ice breaker without screws through a 5.5 foot thick ice layer at a speed of 2.3 knots is plotted by the horizontal dashed line labeled "Resistance without Screws".

The "Resistance with Screws" and "Horsepower" plots are based on test data or the actual model resistance and screw torque, respectively, scaled to full size. The "Resistance without Screws" plot is an estimate calculated by Vance's predictor equation. Vance's predictor equation showed close agreement with model test results (G. P. Vance, 1975, A scaling system for vessels modeled in ice: Paper presented at *Ice Tech* 75, Soc. Naval Architects and Marine Engineers, p. $H^1$-1-$H^1$-34.)

The plot of FIG. 8 shows, for the given conditions, that the screws of the present invention provide a significant reduction in the resistance to the movement of a vessel through an ice covered body of water. In fact, the screws can reduce the resistance between the vessel and the ice to zero if they are rotated at a speed slightly greater than 110 RPM.

This means that the screws alone, operating at that speed, would propel the vessel through a 5.5 foot thick ice layer at a speed of 2.3 knots. Note also that it would require approximately 33,000 horsepower to rotate the screws at a speed slightly greater than 110 RPM.

Since the horsepower required to rotate the screws increases more rapidly than the resistance to the movement of the vessel through the ice decreases with increasing screw speed, it is apparent that the screws are more efficient at the lower rotational speeds over the plotted range.

Therefore, it may be advantageous and thus a preferred embodiment to run the screws at a low rotational speed and supplement the rest of the thrust needed to move the vessel through the ice from a conventional propulsion source such as a marine propeller system. The estimated total required horsepower of the combined screws and marine propellers is plotted as a function of the screw speed in FIG. 9.

As in FIG. 8, the plot of FIG. 9 is for a Wind Class ice-breaker moving through ice 5.5 feet thick at a speed of 2.3 knots. The solid line denoted "Screw Horsepower" indicates the horsepower needed to rotate the screws at the corresponding screw speed. The additional thrust needed to move the vessel through the 5.5 feet thick ice layer at a speed of 2.3 knots is supplied by the marine propeller system. The horsepower needed to develop the required thrust from the marine propeller system is plotted and labeled "Marine Propeller Horsepower". The sum of the "Screw Horsepower" and the "Marine Propeller Horsepower" is the total horsepower required to move the vessel through the 5.5 feet thick ice at the speed of 2.3 knots and is shown by the solid line labeled "Total Horsepower".

The minimum horsepower of the combined system, screws and marine propellers, needed to move the vessel through 5.5 feet thick ice at 2.3 knots is approximately 25,000 horsepower in a screw speed range of approximately 45 to 60 RPM. This should be compared to 33,000 horsepower needed to move the vessel through 5.5 feet thick ice at a speed of 2.3 knots with the screws alone and to 50,000 horsepower needed to propel the vessel through ice 5.5 feet thick at a speed of 2.3 knots by the marine propeller system alone.

The test results disclosed herein are only indicative of the performance capabilities and advantages of the present invention. There are a large number of variables apparent to one skilled in the art for any given set of circumstances which can alter the invention's precise performance under those circumstances. These variables would include screw pitch, screw blade depth, screw taper, angle of inclination of the screw's line of contact, distribution of weight in the vessel, friction factor between the vessel and the ice, strength of the ice, and others.

It should be evident that the present invention significantly reduces the total power required to move an icebreaker vessel, having an ice-breaking bow means adapted to impart a downward force upon ice, through an ice covered body of water and will assist such a structure which is disposed within an ice covered body of water to resist the lateral forces exerted on it by a moving layer of ice as well as assist vertical support members to also resist moving layers of ice.

It is additionally an important advantage of the invention that it presents means for movement and stability in ice covered waters that are not available from apparatus of the prior art regardless of the horsepower considerations.

The structures of the invention can be readily adapted to perform a wide variety of functions besides drilling and production in an ice covered water environment. Examples would include facilities for power generation, petroleum processing, LNG plants, all varieties of petrochemical production and the like.

We claim:

1. A water-navigable vessel, including improved means for failing ice in front of said vessel, said means comprising in combination:

a. ice-breaking bow means on said vessel adapted to impart a downward force upon said ice such that said ice breaks in flexure, and b. ice-gripping, pulling rotatable screw means rigidly supported from said bow means wherein said ice-gripping screw means is adapted and constructed to grip the upper portion of said ice to pull said bow forward and up onto said ice to fail said ice.

2. A water-navigable vessel, including improved means for failing ice in front of said vessel, said means comprising in combination:

a. ice-breaking bow means on said vessel adapted to impart a downward force upon contact with said ice such that said ice breaks in flexure;

b. ice-gripping screw means rotatable in bearings rigidly supported from a forward portion of said vessel; and (i) said screw means having a length to diameter ratio greater than 2 to 1, the exterior helical edge of said screw means being adapted and constructed to cut into and engage said ice when in contact therewith;

(ii) said screw means having its longitudinal axis oriented with respect to said vessel such that rotation of said screw means when in contact with the upper portion of said ice translates the rotational energy of said screw means into components of force both pulling said bow up onto said ice and pulling said bow forward, which components urge said bow means onto said ice to fail it;

c. means for rotating said screw means.

3. A water-navigable vessel, including propulsion means for propelling said vessel through ice-covered water, and further including improved means for failing ice in front of said vessel, said latter means comprising in combination:

a. ice-breaking bow means on said vessel adapted to impart a downward force upon contact with said ice such that said ice breaks in flexure;

b. ice-gripping screw means rotatable in bearings rigidly supported from a forward portion of said vessel; and (i) said screw means having a length to diameter ratio greater than 2 to 1, the exterior helical edge of said screw means adapted and constructed to cut into and engage said ice when in contact therewith;

(ii) said screw means having its longitudinal axis oriented with respect to said vessel such that rotation of said screw means when in contact with the upper portion of said ice translates the rotational energy of said screw means into components of force both pulling said bow up onto said ice and pulling said bow forward, which components in cooperation with said propulsion means urge said bow means onto said ice to fail it;

c. means for rotating said screw means.

4. A water-navigable vessel, including improved means for failing ice in front of said vessel, said latter means comprising in combination:

a. ice-breaking bow means on said vessel adapted to impart a downward force upon contact with said ice such that said ice breaks in flexure;

b. ice-gripping screw means rotatable in bearings rigidly supported from a forward portion of said vessel; and (i) said screw means having a length to diameter ratio greater than 2 to 1, the exterior helical edge of said screw means adapted and constructed to cut into and engage said ice when in contact therewith and wherein said screw means comprises a shaft and helical blade affixed to said shaft such that the pitch of said screw means increases from fore to aft;

(ii) said screw means having its longitudinal axis aligned within a vertical plane generally parallel to the portion of said vessel opposite said screw means such that rotation of said screw means when in contact with said ice translates the rotational energy of said screw means into components of force both pulling said bow up onto said ice and pulling said bow forward which components urge said bow means onto said ice to fail it;

c. means for rotating said screw means.

5. A water-navigable vessel, including propulsion means for propelling said vessel through ice-covered water, and further including improved means for failing ice in front of said vessel, said latter means comprising in combination:

a. ice-breaking bow means on said vessel adapted to impart a downward force upon contact with said ice such that said ice breaks in flexure;

b. ice-gripping screw means rotatable in bearings rigidly supported from a forward portion of said vessel; and (i) said screw means having a length to diameter ratio greater than 2 to 1, the exterior helical edge of said screw means adapted and constructed to cut into and engage said ice when in contact therewith;

(ii) said screw means having its longitudinal axis aligned within a vertical plane generally parallel to the portion of said vessel opposite said screw means such that rotation of said screw means when in contact with said ice translates the rotational energy of said screw means into components of force both pulling said bow up onto said ice and pulling said bow forward, which components in cooperation with said propulsion means urge said bow means onto said ice to fail it;

c. means for rotating said screw means.

6. The vessel of claim 5 wherein the vertical plane containing a rotational axis of said screw means intersects the vertical plane containing the longitudinal axis of said vessel at an angle less than or equal to 45°.

7. The vessel of claim 6 wherein the vertical plane containing the rotational axes of said screw means are substantially parallel to the vertical plane containing the longitudinal axis of the vessel.

8. The vessel of claim 5 wherein said screw means comprises two separately mounted independent screws.

9. The vessel of claim 8 wherein each screw comprises a screw shaft and a helical blade affixed to said screw shaft.

10. The vessel of claim 9 wherein one screw is positioned on one side of the longitudinal axis of said vessel and is right-handed and the other screw mounted on the other side of the longitudinal axis of said vessel is left-handed.

11. The vessel of claim 10 wherein said right-handed and left-handed rotatable screws also serve to clear said failed ice out of the path of said vessel.

12. The vessel of claim 9 having supplemental means outfitted on the crest of said screw blades for facilitating the cutting of a groove in the layer of ice which the blades can ride in to develop the tractional force which moves the vessel forward and upward onto the layer of ice.

13. The vessel of claim 8 where said screws are tapered by increasing the blade depth from fore to aft.

14. The vessel of claim 8 wherein said screws are tapered by increasing the diameters of said screw shafts from fore to aft.

15. The vessel of claim 8 wherein the pitch of said screws increases from fore to aft.

16. The vessel of claim 8 wherein each of said screws has its line of contact inclined forwardly and upwardly from the water line at an angle greater than 0° but less than or equal to 45°.

17. The vessel of claim 5 wherein said screw means and said means for rotating said screw means are adapted in a manner such that the screw means can be rotated to move the points of contact, relative to the ice layer, in a rearward direction parallel to the vessel's longitudinal axis at a velocity which is not more than twice the designed maximum velocity, relative to the layer of ice, of the vessel through the layer of ice.

18. Vessel for breaking a layer of ice floating on a body of water by failing the ice layer in flexure comprising:

a. a floating vessel having an ice-breaking bow;

b. rotatable screw means attached to the bow of said vessel, one screw means being positioned on each side of the longitudinal axis of the vessel, each of said screw means having its line of contact inclined upwardly and forwardly, each of said screw means being positioned to contact the ice layer along the lower side of said means and being configurated to generate a force to pull the bow of said vessel forward and upward onto the layer of the ice whereby at least a part of the weight of said vessel breaks the layer of ice, substantially all of said pulling force generated by said screw means resulting from the screw means contacting the ice layer; and c. means for rotating said screw means.

19. A water-navigable vessel, including improved means for failing ice in front of said vessel, said means comprising in combination:

a. ice-breaking bow means on said vessel adapted to impart a downward force upon said ice such that said ice breaks in flexure, and b. ice-gripping, rotatable screw means rigidly supported from said bow means wherein said ice-gripping screw means is adapted and constructed, upon rotation, to grip the upper portion of said ice and pull said vessel onto said ice.

* * * * *

UNITED STATES PATENT AND TRADEMARK OFFICE

CERTIFICATE OF CORRECTION

PATENT NO. : 4,208,977

DATED : June 24, 1980

INVENTOR(S) : Hans O. Jahns and Joe D. Wheeler

It is certified that error appears in the above—identified patent and that said Letters Patent is hereby corrected as shown below:

At column 1, line 18, delete "water" and insert --cover--.
At column 3, line 37, delete "low" and insert --bow--.
At column 4, line 48, delete "enabble" and insert --enable--.
At column 6, line 59, delete "bos" and insert --box--.
At column 6, line 63, delete "68" and insert --58--.
At column 7, line 22, delete "of the top flared end".
At column 8, line 5, add --vertical-- at the end of the line.

Signed and Sealed this

*Twentieth* Day of *July 1982*

[SEAL]

*Attest:*

GERALD J. MOSSINGHOFF

*Attesting Officer*

*Commissioner of Patents and Trademarks*